US005133498A

United States Patent [19]

Sealy et al.

[11] Patent Number: 5,133,498

[45] Date of Patent: Jul. 28, 1992

[54] APPARATUS FOR DISPENSING/APPLYING A MATERIAL

[76] Inventors: John Michael Sealy, 7808 Southwestern, Dallas, Tex. 75225; Roger C. Sharlow, 1417 Judy Dr., Plano, Tex. 75074

[21] Appl. No.: 579,832

[22] Filed: Sep. 10, 1990

[51] Int. Cl.[5] ..... B05B 7/30

[52] U.S. Cl. ..... 239/68; 239/70; 239/310; 137/382; 137/895

[58] Field of Search ..... 239/10, 68, 310, 316, 239/318, 70; 137/382, 888, 895

[56] References Cited

U.S. PATENT DOCUMENTS

| | | | |
|---|---|---|---|
| 2,215,132 | 9/1940 | Parker | 239/310 X |
| 2,606,068 | 8/1952 | Bonacor | 239/310 X |
| 3,112,884 | 12/1963 | Gilmour | 239/318 |
| 3,260,464 | 7/1966 | Harant | 239/310 X |
| 3,608,829 | 3/1971 | Forsman | 239/318 |
| 3,791,410 | 2/1974 | Sapiano | 239/318 X |
| 3,940,069 | 2/1976 | Gunzel, Jr. et al. | 239/318 |
| 4,340,179 | 7/1982 | Knapp | 239/310 |
| 4,385,034 | 5/1983 | Gacer | 239/310 X |
| 4,527,740 | 7/1985 | Gunzel, Jr. et al. | 239/318 |
| 4,846,222 | 7/1989 | Jang | 239/68 |

*Primary Examiner*—Andres Kashnikow
*Assistant Examiner*—William Grant

[57] ABSTRACT

This invention includes a process and apparatus for dispensing/applying a material to lawns and gardens. The apparatus includes a child and pet proof container for holding the material being dispensed/applied. At the upper portion of the container in a water flow path is a water fill conduit, liquid volume control, back flow prevention device, and a Venturi. The Venturi draws the contents of the container through a hose having an end located at the containers lower end where there is a filter located at such hose end. This allows hazardous material to be administered to a lawn or other flora without human or animal exposure to hazardous material.

25 Claims, 2 Drawing Sheets

APPARATUS FOR DISPENSING/APPLYING A MATERIAL

SUMMARY OF THE INVENTION

This invention includes a process and apparatus for applying a material. The apparatus includes a child proof container for holding the material being applied. At the upper portion of the container in a water flow path is a water fill conduit, liquid volume control, back flow prevention device, and a Venturi. The Venturi draws the container mixture through a hose having an end located at the containers lower end where there is a filter located at such hose end. This permits hazardous material to be administered to a lawn or other flora without human or animal exposure to such hazardous material.

BRIEF DESCRIPTION OF THE DRAWINGS

The invention may be more fully understood when the accompanying Detailed Description is read in conjunction with the following Drawings.

DETAILED DESCRIPTION OF THE DRAWINGS

Figure 1:
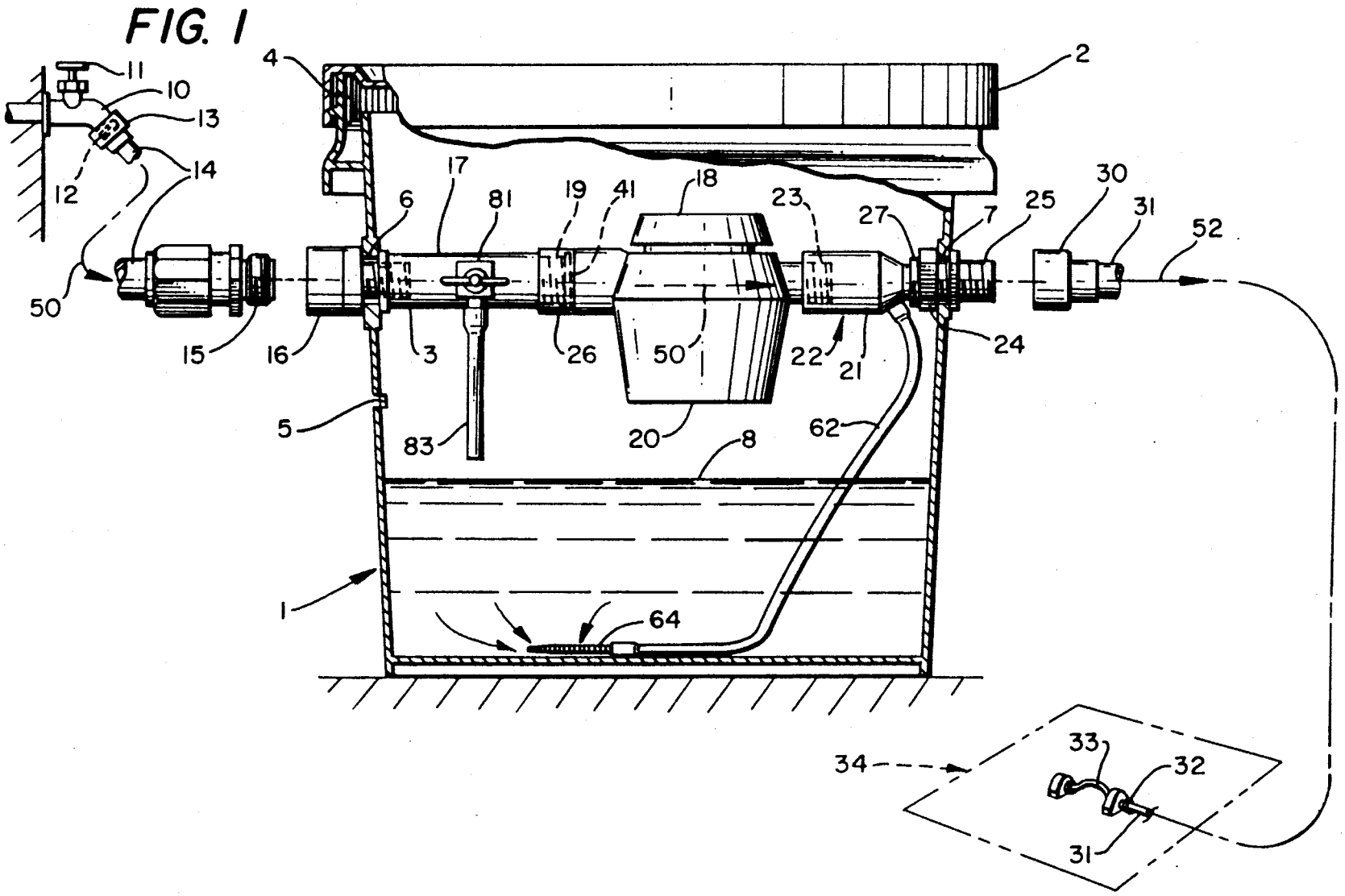
FIG. 1 is an elevational view, a portion of which is shown in cross-section, of an embodiment of the invention, which shows a cross-section of a lidded container which is connected to a water supply and a sprinkler system.

Referring first to FIG. 1, the major components are a container 1, a liquid fill conduit 17 for filling both the container and being part of a liquid flow path 50, the liquid volume control 20, the back flow preventer and Venturi 22, and the sprinkler 33. There is shown a container 1 with a child proof latch 4 on lid 2 shown above the container 1 which are both threaded for attaching the lid 2 to the container 1. Located in the upper part of the container 1 is a liquid flow path 50 which is generally separated from liquid solution 8 located in the lower part of the container 1. Threadedly attached to the container 1 is a hose 14 where the hose has a male threaded end 15, which is threadedly connected to a female/male threaded fitting 16 which is threadedly connected to the liquid fill conduit 17 which is capable of passing through liquid flow 50 or diverting a portion of the liquid flow 50 to the pail concentrate 8 by means of a diverter valve 81 to which is attached a rubber hose 3 which allows the control of the direction of water flow 50 to the pail 1. The female/male threaded fitting 6 passes through an aperture 6 in the wall of the container 1 to threadedly attach to the liquid fill conduit 17. On one end of liquid fill conduit 17, there is a male fitting 19 which is threadedly attached to a female threaded end 26 of a liquid volume control 20 which is capable of stopping liquid flow 50 after a manual preset 18 adjustable amount of liquid passes through it. The male threaded fitting 23 of the liquid volume control 20 is threadedly attached to the combination back flow preventer and Venturi 22 which ha a male threaded end 27 which is threadedly connected with the female/male fitting 24. The male end portion of the female/male fitting 24 passes through the aperture 7 and threadedly connected thereto is a female/male fitting lock ring 25 which has internal threads which threadedly connects to the threaded male end of the female/male fitting 24 and also the female/male fitting lock ring 25 has external threads that are sized to accept the female end 30 of a standard garden hose 31. The male threaded fitting 23 of the liquid volume control 20 is threadedly attached to the combination back flow preventer and Venturi 22 which has a male threaded end 27 which is threadedly connected with the female threaded end of a female/male fitting 24. A female/male fitting lock ring 25 is threadedly connected to the female threaded end 30 of a standard garden hose 31.

The means by which the liquid flow path 50 apparatus is held in place in the upper part of container 1 is by tightly formed connections where the female end 3 of the liquid fill conduit 17 is connected to the male end of female/male fitting 16 inside the container 1 and which also passes through aperture 6 and it has a female end which is located outside and abutting the container 1 and which is sized larger than aperture 6. Working together with the inlet connection, on the opposite outlet side of container 1 there is the male threaded end 27 of combination back flow and Venturi 22 which is threadedly connected to the female end of female/male fitting 24 which female/male fitting has a male end portion which passes through aperture 7 and a female/male fitting lock ring 25 is threadedly connected thereto and locks against the wall of the container 1 and the two tight connections holds the fluid flow path 50 rigidly near the top of the interior of container 1. The female threaded end 30 of the garden hose 31 is connected to the threaded female fitting 32 of a conventional sprinkler 33.

A standard water hose bib 10 has faucet stem and handle 11 for turning on and off a water supply and which also has a male threaded spout end 12 that is threadedly connected to the female threaded end 13 of the garden hose 14. The container 1 has a slot 5 in its side wall. The main function of this slot 5 is to prevent container 1 liquids 8 from covering the outer orifice 21 of the back flow preventer 22.

The way the apparatus is used is to release latch 4 and remove lid 2, fill container 1 with water from the fill conduit 17. Next the hazardous material or other liquids are poured or placed into the bottom of the container 1 to form the dilution 8. The manual preset volume control 18 is set, based upon the amount of water to be placed upon the lawn area 34. The lid 2 is then screwed onto the top of the container 1. The water is turned on by using the handle 11. Water travels through hose 14 into the liquid fill conduit 17 and then into the liquid volume control 20 and then through the combination back flow preventer and Venturi 22 and then to the sprinkler, which combined apparatus describes the water flow paths 50 and 52.

Figure 2:
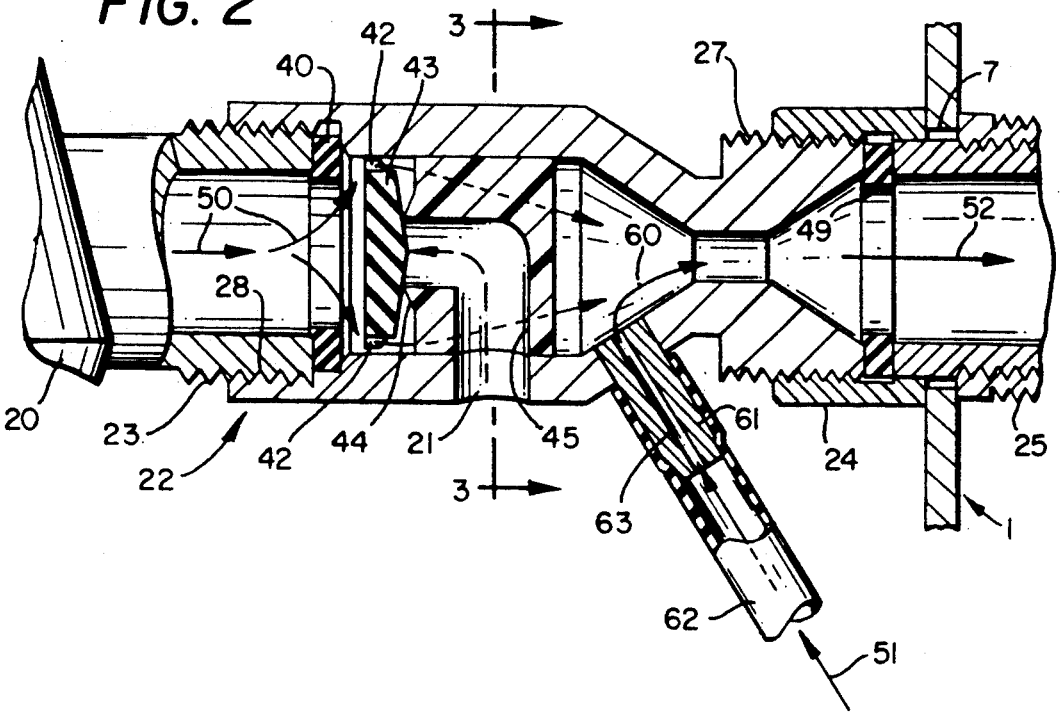
FIG. 2 is a longitudinal cross-section of a back flow preventer and Venturi.

In combination with FIG. 1, FIG. 2 shows the action of the back flow preventer and Venturi 22. As the water flows through the Venturi 22, the Venturi action causes the introduction of hazardous or other liquids by flow path 51 to be drawn into the water flow path 50. The measured combined water and hazardous material 8 or other liquids combines to form a fluid mixture 52, which then passes through the hose 31 into the sprinkler 33, where the combined stream 52 is applied to a lawn area 34 or other flora. The Venturi action allows control and the ability to flow an exact ratio of water to solution 8 by means of dilution flow path 51 and through passage way diameter 63. The Venturi action draws solution 8 through a filter 64 into the hose 62 which is connected to a tubular orifice 61 that controls the Venturi mixture 60.

Figure 3:
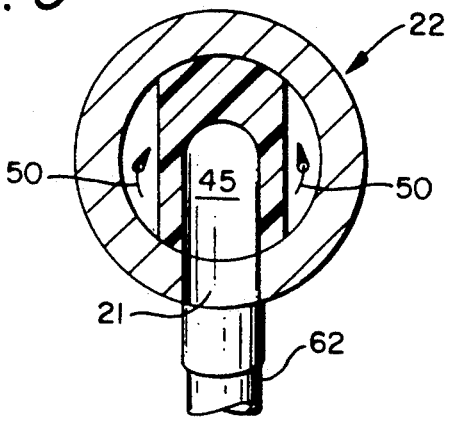
FIG. 3 is a lateral cross-section of the back flow preventer and Venturi as indicated in FIG. 2.

FIG. 2 shows a longitudinal cross section of the combination back flow preventer and Venturi 22 and FIG. 3 shows a lateral cross section of the combination back flow preventer and Venturi 22. At each end of the combination back flow preventer and Venturi 22, and liquid volume control are male threads 27, female threads 28, and female threads 26. Located at the end of male threads 19, male threads 23, and male threads 27 are gaskets 41, 40 and 49, respectively for the proper sealing with the female threads 26 (FIG. 1) of the liquid volume control 20, female threads 28 of the combination back flow preventer and. Venturi 22, and female threads 39 of the female/male fitting 24. Water flow enters the combination back flow preventer and Venturi 22 and its direction is shown by arrows 50. The water flow then strikes the washer 43 which is capable o a short lateral movement and is stopped by a shoulder 44 which seals the top of the back flow preventer passage 45 which is open to the atmosphere by way of opening 21 (FIG. 2 and 3). As the water flow path 50 passes around washer 43, the water flow forces washer 43 against shoulder 44 which seals the outside atmosphere from entering the unit, by the slotted passage areas 42, and over the top of orifice 63 which creates a Venturi effect which creates a vacuum; and this vacuum draws the fluids 8 in the container 1 which is pulled through tube 62 and into the sized orifice 63 which controls the flow of liquid 8 into the water flow path 50. The combined liquids flow 52 then exits the combination back flow preventer and Venturi 22. If the water flow is stopped and a back flow condition could result, before solution 8 could travel backwards through unit 22, air would travel through passage 45 and move the washer 43 laterally. This action would stop the vacuum that draws solution 8 up the tube and into the water flow path 50. This is a preventive action to assure proper separation of dilution 8 and water flow 50 in a back flow situation. The liquid volume control may function by measuring liquid volume or the control may function by the passage of time increments.

Figure 4:
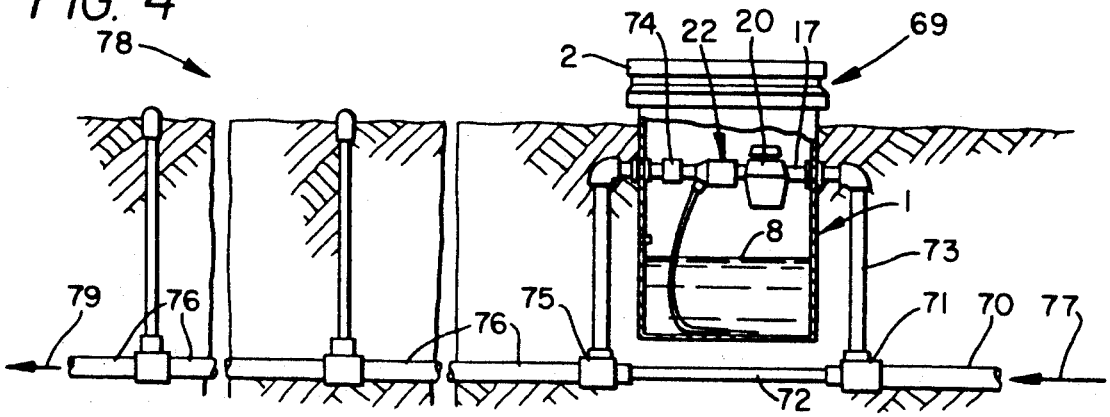
FIG. 4 is an elevational view of an under ground sprinkler system which is connected to an in ground piping system.

FIG. 4 represents an underground sprinkler system 78 and the dispensing unit 69 connected to it. The water flow path 77 comes through pipe 70 and enters a tee fitting 71 where some of the water is diverted to the dispensing unit through pipe 73 and some of the water is allowed to pass through pipe 72 which bypasses the dispensing unit 69. The water which passes into pipe 7 connects to the liquid fill conduit 17 and on to the liquid volume control 20 and on to the Venturi 22 where the solution 8 is mixed with the water flow. The mixed solution passes through a check valve 74 which will only allow liquid flow in one direction; this check valve prevents liquid from flowing back into the container 1. The mixed solution leaves the container 1 and flows into fitting 75 where the solution is mixed with the water from pipe 72. The liquid mixture 79 then travels through the rest of the piping 76 to be distributed to the sprinkler system 78 and the area it serves.

All of the elements of this invention are commercially available. For example a child proof latch 4 and lid 2 are disclosed in U.S. Pat. No. 4,732,288 issued Mar. 22, 1988 and is entitled Child-Resistant Molded Plastic Containers Lid For Open Head Containers. The liquid volume control 20, and combination back flow preventer and Venturi 22 are also commercially available. The essence of the invention is the unavailable combination of the off the shelf items in a fashion to permit the application of hazardous material onto a lawn or other flora without exposure to humans or animals as they are being applied.

We claim:

1. An apparatus for dispensing a mixture of water and a material, comprising:

a container having a base and at least one sidewall which defines an interior of said container, said sidewall having a water inlet and a liquid mixture outlet formed therein;

means for at least partially filling said interior of said container with water for mixing with a material deposited therein;

a first internal liquid conduit connected between said water inlet and said liquid mixture outlet for permitting the flow of liquids therebetween;

a second internal liquid conduit having a first, open end positioned within said interior of said container and a second end connected to said first internal liquid conduit, whereby the flow of water through said first internal liquid conduit draws a mixture of water and said material through said second internal liquid conduit and into said first internal liquid conduit;

mixture dispersement control means connected to said first internal conduit between said water inlet and the connection between said first and second internal liquid conduits, said mixture dispersement control means controlling the amount of material dispersed by closing said first internal liquid conduit at a preselected threshold value; and a lockable lid mated with said container sidewall to limit access to said first and second internal liquid conduits, and said mixture dispersement control means.

2. An apparatus for dispensing a mixture of water and a material according to claim 1 wherein said mixture dispersement control means is a liquid volume controller which measures the amount of water flowing therethrough and closes said first internal conduit when the measured volume of water exceeds a selected water volume.

3. An apparatus for dispensing a mixture of water and a material according to claim 1 wherein said mixture dispersement control means is a timer which closes said first internal conduit upon expiration of a selected time interval.

4. An apparatus for dispensing a mixture of water and a material according to claim 1 wherein said means for at least partially filling said interior of said container with water for mixing with a material deposited therein further comprises:

a diverter valve connected to said first internal conduit between said water inlet and said mixture dispersement control means, said diverter valve movable between a first position whereby water supplied to said container flows through said first internal conduit and exits through said liquid mixture outlet and a second position whereby water is diverted into said interior of said container for mixing with said material deposited therein;

wherein the mating of said lockable lid and said container sidewall also limits access to said diverter valve.

5. An apparatus for dispensing a mixture of water and a material according to claim 2 and further comprising a filter mounted on said first end of said second internal conduit, said filter preventing particulate matter within said interior of said container from being drawn into said second internal conduit.

6. An apparatus for dispensing a mixture of water and a material according to claim 2 and further comprising a backflow preventer connected to said first internal conduit between said mixture dispersement control means and said connection between said first and second internal liquid conduits, said backflow preventer preventing said mixture of water and said material from entering said mixture dispersement control means.

7. An apparatus for dispensing a mixture of water and a material according to claim 6 wherein said first internal liquid conduit further comprises a narrowed segment, said second internal liquid conduit connecting to said first internal liquid conduit in said narrowed segment.

8. An apparatus for dispensing a mixture of water and a material according to claim 7 wherein said narrowed segment is a venturi and said second internal liquid conduit connects to said first internal liquid conduit in the converging portion of said venturi.

9. An apparatus for dispensing a mixture of water and a material, comprising:

a container having a base and at least one sidewall which defines an interior of said container, said sidewall having a water inlet and a liquid mixture outlet formed therein;

means for at least partially filling said interior of said container with water for mixing with a material deposited therein;

a first internal liquid conduit having a first end connected to said water inlet for the delivery of water thereto and a second end;

a second internal liquid conduit having a first end, a second end connected to said liquid mixture outlet and a venturi passage therebetween;

mixture dispersement control means having a water inlet connected to said second end of said first internal liquid conduit and an outlet connected to said first end of said second internal liquid conduit, said mixture dispersement control means controlling the amount of material dispersed by closing said first internal liquid conduit at a preselected threshold value;

a third internal liquid conduit having a first, open end positioned within said interior of said container and a second end connected to said second internal liquid conduit at the converging section of said venturi passage, whereby the flow of water through said second internal liquid conduit draws a mixture of water and said material through said third liquid conduit and into said second liquid conduit;

a filter mounted on said first end of said third internal conduit, said filter preventing particulate matter within said interior of said container from being drawn into said third internal conduit; and a backflow preventer connected to said second internal conduit between said mixture dispersement control means and the converging section of said venturi passage, said backflow preventer preventing said mixture of water and said material from entering said mixture dispersement control means.

10. An apparatus for dispensing a mixture of water and a material according to claim 9 and further comprising a lockable lid mated with said container sidewall to limit access to said first, second and third internal liquid conduits, said mixture dispersement control means, said filter and said backflow preventer.

11. An apparatus for dispensing a mixture of water and a material according to claim 10 wherein said backflow preventer has an aperture in communication with atmosphere and wherein said backflow preventer further comprises a washer movable by the forward flow of water therethrough into a first position which closes said aperture and movable by air pressure in the absence of the forward flow of water into a second position which closes said second internal conduit to isolate said mixture dispersement control means.

12. An apparatus for dispensing a mixture of water and a material according to claim 11 wherein said aperture is positioned within said interior of said container and wherein the mating of said lockable lid and said container sidewall also limits access to said aperture.

13. An apparatus for dispensing a mixture of water and a material according to claim 12 wherein said means for at least partially filling said interior of said container with water for mixing with a material deposited therein further comprises:

a diverter valve connected to said first internal conduit between said first and second ends, said diverter valve movable between a first position whereby water supplied to said container flows through said first internal conduit and exits said second end of said first internal conduit and a second position whereby water is diverted into said interior of said container for mixing with said material deposited therein;

wherein the mating of said lockable lid and said container sidewall also limits access to said diverter valve.

14. An apparatus for dispensing a mixture of water and a material, comprising:

a first water conduit having a first end connected to water supply means and a second end;

a first tee fitting having a first entrance opening connected to said second end of said first water conduit and first and second exit openings;

a second water conduit having a first end connected to said first exit opening of said first tee fitting and a second end;

a third water conduit having a first end connected to said second exit opening of said first tee fitting and a second end, said tee fitting dividing water supplied to said first water conduit between said second and third water conduits;

a container having a base and at least one sidewall which defines an interior of said container, said sidewall having a water inlet connected to said second end of said second water conduit and a liquid mixture outlet formed therein;

means for at least partially filling said interior of said container with water for mixing with a material deposited therein;

a first internal liquid conduit connected between said water inlet and said liquid mixture outlet for permitting the flow of liquids therebetween;

a second internal liquid conduit having a first, open end positioned within said interior of said container and a second end connected to said first internal liquid conduit, whereby the flow of water through said first internal liquid conduit draws a mixture of water and said material through said second internal liquid conduit and into said first internal liquid conduit;

mixture dispersement control means connected to said first internal liquid conduit between said water inlet and the connection between said first and second internal liquid conduits, said mixture dispersement control means controlling the amount of material dispersed by closing said first internal liquid conduit at a preselected threshold value;

a fourth water conduit having a first end connected to said liquid mixture outlet and a second end;

a second tee fitting having a first entrance opening connected to said second end of said fourth water conduit, a second entrance opening connected to said second end of said third water conduit and an exit opening; and a fifth water conduit having a first end connected to said exit opening of said second tee fitting and a second end;

wherein said second tee fitting combines the mixture of material and water supplied to said fourth water conduit and water flowing through said third water conduit and supplies the combination to said fifth water conduit.

15. An apparatus for dispensing a mixture of water and a material according to claim 14 and further comprising a lockable lid mated with said container sidewall to limit access to said first and second internal liquid conduits, and said mixture dispersement control means.

16. An apparatus for dispensing a mixture of water and a material according to claim 15 wherein said means for at least partially filling said interior of said container with water for mixing with a material deposited therein further comprises:

a diverter valve connected to said first internal conduit between said water inlet and said mixture dispersement control means, said diverter valve movable between a first position whereby water supplied to said container flows through said first internal conduit and exits through said liquid mixture outlet and a second position whereby water is diverted into said interior of said container for mixing with said material deposited therein;

wherein the mating of said lockable lid and said container sidewall also limits access to said diverter valve.

17. An apparatus for dispensing a mixture of water and a material according to claim 16 and further comprising a filter mounted on said first end of said second internal conduit, said filter preventing particulate matter within said interior of said container from being drawn into said second internal conduit.

18. An apparatus for dispensing a mixture of water and a material according to claim 17 and further comprising a backflow preventer connected to said first internal conduit between said mixture dispersement control means and said connection between said first and second internal liquid conduits, said backflow preventer preventing said mixture of water and said material from entering said mixture dispersement control means.

19. An apparatus for dispensing a mixture of water and a material according to claim 18 wherein said first internal liquid conduit further comprises a narrowed segment, said second internal liquid conduit connecting to said first internal liquid conduit in said narrowed segment.

20. An apparatus for dispensing a mixture of water and a material according to claim 19 wherein said narrowed segment is a venturi and said second internal liquid conduit connects to said first internal liquid conduit in the converging portion of said venturi.

21. An apparatus for dispensing a mixture of water and a material according to claim 20, wherein said backflow preventer has an aperture in communication with atmosphere and wherein said backflow preventer further comprises a washer movable by the forward flow of water therethrough into a first position which closes said aperture and movable by air pressure in the absence of the forward flow of water into a second position which closes said first internal conduit to isolate said mixture dispersement control means.

22. An apparatus for dispensing a mixture of water and a material according to claim 21 wherein said aperture is positioned within said interior of said container and wherein the mating of said lockable lid and said container sidewall also limits access to said aperture.

23. An apparatus for dispensing a mixture of water and a material according to claim 22 and further comprising a check valve mounted to said first internal liquid conduit between said liquid mixture outlet and said narrowed segment, said check valve preventing liquid from entering said container through said liquid mixture outlet.

24. An apparatus for dispensing a mixture of water and a material according to claim 23 and further comprising liquid dispersal means connected to said second end of said fifth water conduit, said liquid dispersal means dispersing the combination of the mixture of material and water supplied to said fourth water conduit and water flowing through said third water conduit.

25. An apparatus for dispensing a mixture of water and a material according to claim 23 wherein said apparatus is installed underground and accessible only by removing said lockable lid.

* * * * *

UNITED STATES PATENT AND TRADEMARK OFFICE

CERTIFICATE OF CORRECTION

PATENT NO. : 5,133,498

DATED : July 28, 1992

INVENTOR(S) : John Michael Sealy and Roger C. Sharlow

It is certified that error appears in the above-identified patent and that said Letters Patent is hereby corrected as shown below:

Column 1, line 56, "3" should be --83--.

Column 1, line 58, "6" should be --16--.

Column 3, line 19, delete "." after the word "and".

Column 3, line 23, "o" should be --of--.

Column 3, line 54, "7" should be --73--.

Signed and Sealed this

Twelfth Day of April, 1994

Bruce Lehman

*Attest:*

BRUCE LEHMAN

*Commissioner of Patents and Trademarks*

*Attesting Officer*